US005493790A

United States Patent [19]

Brossard

[11] Patent Number: 5,493,790

[45] Date of Patent: Feb. 27, 1996

[54] SHEET TRANSFER APPARATUS

[75] Inventor: Edward L. Brossard, Janesville, Wis.

[73] Assignee: Beloit Technologies, Inc., Wilmington, Del.

[21] Appl. No.: 381,162

[22] Filed: Jan. 31, 1995

[51] Int. Cl.[6] ..... F26B 11/02

[52] U.S. Cl. ..... 34/117; 34/120

[58] Field of Search ..... 34/110, 111, 114, 34/115, 116, 117, 120, 122

[56] References Cited

U.S. PATENT DOCUMENTS

| | | | |
|---|---|---|---|
| 4,625,434 | 12/1986 | Karlsson et al. | 34/122 |
| 5,185,063 | 2/1993 | Aula et al. | 34/117 |
| 5,232,555 | 8/1993 | Daunais et al. | 34/117 |
| 5,248,390 | 9/1993 | Fissmann et al. | 34/117 |
| 5,269,075 | 12/1993 | Brunnmair et al. | 34/117 |
| 5,355,593 | 10/1994 | Kotitschke | 34/120 |
| 5,438,765 | 8/1995 | Tyrmi et al. | 34/115 |

*Primary Examiner*—John T. Kwon
*Attorney, Agent, or Firm*—Dirk J. Veneman; Raymond W. Campbell; David J. Archer

[57] ABSTRACT

A sheet transfer apparatus is disclosed for transferring a web from a drying section to a calender. The apparatus includes a looped felt for supporting the web thereon from the drying section. A lead-out roll is disposed upstream relative to the calender for guiding the felt such that the felt is disposed between the lead-out roll and the web. A full width web blowing device connected to a source of pressurized air is disposed adjacent to the lead-out roll for selectively blowing the web off of the felt. A movable sheet transfer roll is disposed in the vicinity of the lead-out roll, the transfer roll being movable from a first position to a second position adjacent to the lead-out roll. The arrangement is such that when the transfer roll is disposed in the second position thereof, the blowing device blows the full width web off of the felt and onto the transfer roll for subsequent guidance thereof to the calender.

10 Claims, 3 Drawing Sheets

SHEET TRANSFER APPARATUS

BACKGROUND OF THE INVENTION

1. Field of the Invention

The present invention relates to a sheet transfer apparatus for transferring a web from a drying section to a calender. More specifically, the present invention relates to a transfer apparatus for transferring the full width web to a calender.

2. Information Disclosure Statement

In certain applications, it is necessary to dry a web by blowing pressurized heated air onto the web while the web is supported by a felt or wire. Such web drying procedure is known in the art as "through drying" and is particularly applicable to the manufacture of tissue and the like.

Additionally, under certain conditions, it is necessary to calender the through dried web in order to impart certain surface characteristics thereto.

In the prior art arrangements, relatively complex arrangements have been employed for cutting a tail of the web upstream relative to the calender and for subsequently threading such tail through the calender and widening the web to a full width web.

The present invention provides means for transferring a full width sheet or web from a drying section to a calender by blowing the full width sheet off of the supporting felt onto a sheet transfer roll.

Therefore, it is a primary objective of the present invention to provide a sheet transfer apparatus for transferring a full width web from a drying section to a calender.

Other objects and advantages of the present invention will become readily apparent to those skilled in the art by a consideration of the detailed description contained hereinafter, taken in conjunction with the annexed drawings.

SUMMARY OF THE INVENTION

The present invention relates to a sheet transfer apparatus for transferring a web from a drying section to a calender. The apparatus includes a looped felt for supporting the web thereon from the drying section.

A lead-out roll is disposed upstream relative to the calender for guiding the felt such that the felt is disposed between the lead-out roll and the web.

Full width web blowing means connected to a source of pressurized air and disposed adjacent to the lead-out roll are provided for selectively blowing the web off of the felt.

Movable sheet transfer roll means are disposed in the vicinity of the lead-out roll. The transfer roll means is movable from a first position to a second position adjacent to the lead-out roll. The arrangement is such that when the transfer roll means is disposed in the second position thereof, the blowing means blows the full width web off of the felt onto the transfer roll means for subsequent guidance thereof to the calender.

Many variations and modifications of the present invention will become readily apparent to those skilled in the art. However, such modifications and variations fall within the spirit and scope of the present invention as defined by the appended claims.

DETAILED DESCRIPTION OF THE DRAWINGS

Figure 1:
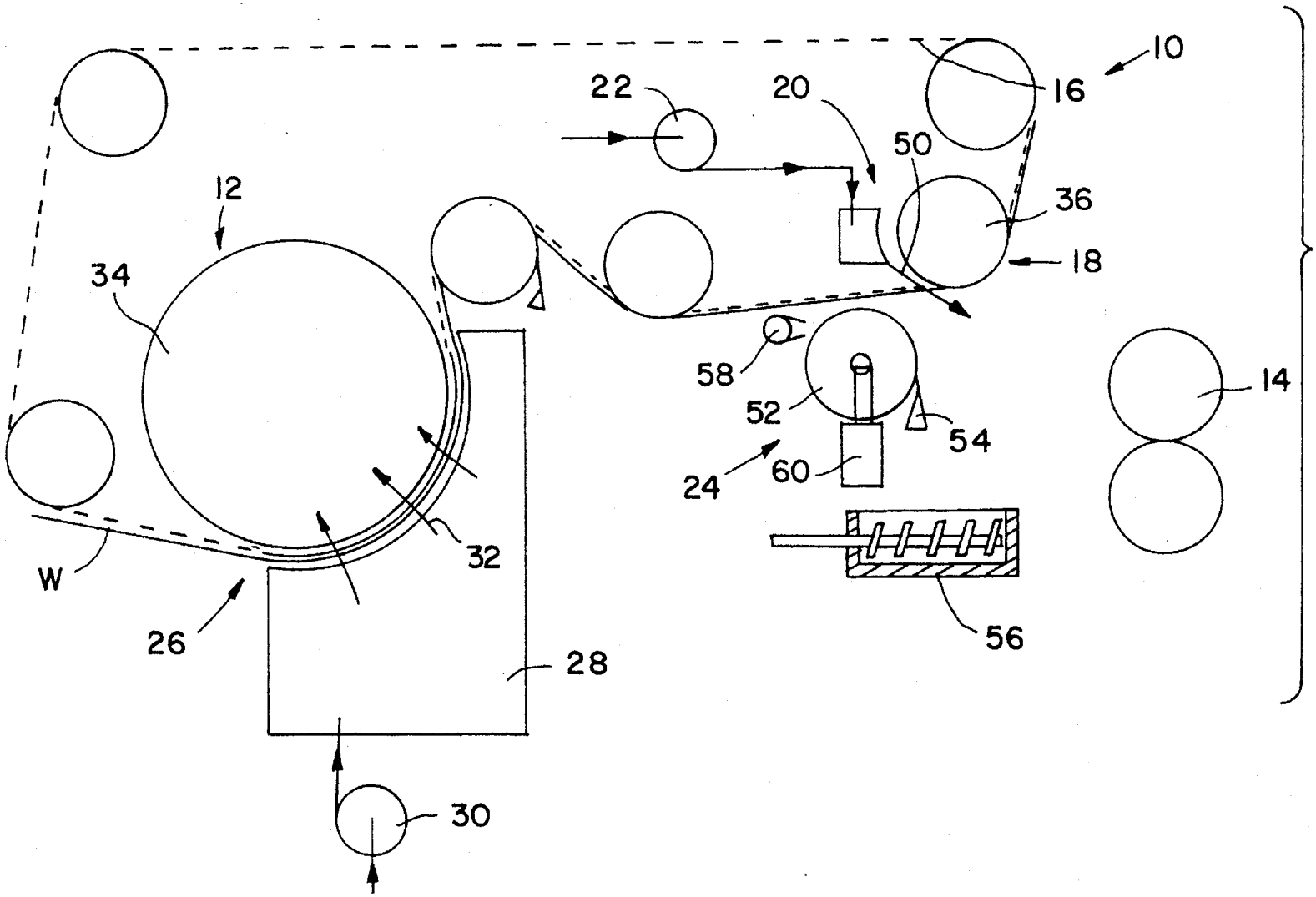
FIG. 1 is a side-elevational view of a sheet transfer apparatus according to the present invention for transferring a web from a drying section to a calender.

As shown in FIG. 1 of the drawings, a sheet transfer apparatus, generally designated 10, transfers a web W from a drying section, generally designated 12, to a calender 14. The apparatus 10 includes a looped felt 16 for supporting the web W thereon from the drying section 12.

A lead-out roll, generally designated 18, is disposed upstream relative to the calender 14 for guiding the felt 16 such that the felt 16 is disposed between the lead-out roll 18 and the web W.

Full width web blowing means, generally designated 20, are connected to a source of pressurized air 22 and are disposed adjacent to the lead-out roll 18 for selectively blowing the web W off of the felt 16.

Figure 2:
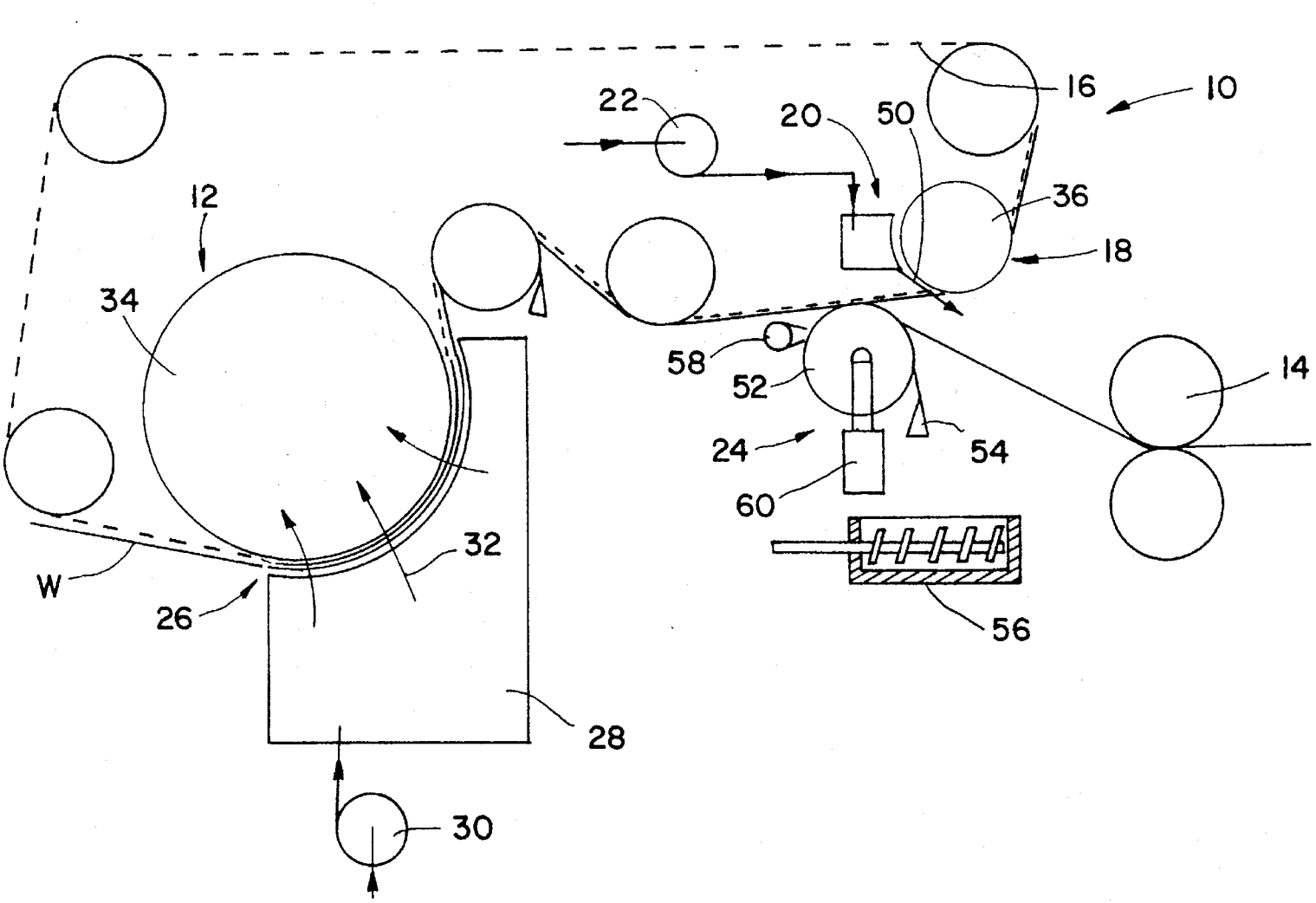
FIG. 2 is a similar view to that shown in FIG. 1, but shows the transfer roll in the second position thereof.

Movable sheet transfer roll means, generally designated 24, are disposed in the vicinity of the lead-out roll 18. The transfer roll means 24 are movable from a first position, as shown in FIG. 1, to a second position, shown in FIG. 2, adjacent to the lead-out roll 18. The arrangement is such that when the transfer roll means 24 is disposed in the second position thereof, as shown in FIG. 2, the blowing means 20 blows the full width web W off of the felt 16 onto the transfer roll means 24 for subsequent guidance thereof to the calender 14.

More specifically, the transfer apparatus 10 includes a dryer section, generally designated 26. The dryer section 26 includes a hot air cap 28 connected to a source of pressurized heated air 30. The air cap 28 directs a flow of heated air, as indicated by the arrow 32, against the web W and through the felt 16 during mutual movement of the felt 16 and the web W past the air cap 28.

The dryer section 26 further includes a perforate drying cylinder 34 which cooperates with the air cap 28 such that during the mutual movement of the felt 16 and the web W between the drying cylinder 34 and the air cap 28, the heated air 32 flows from the air cap 28 through the web W and the felt 16 into the perforate drying cylinder 34.

The felt is preferably a supporting wire capable of withstanding the temperature of the flow of hot air from the air cap 28.

The lead-out roll 18, in one embodiment of the present invention as shown in FIG. 1, is a plain roll 36.

Figure 3:
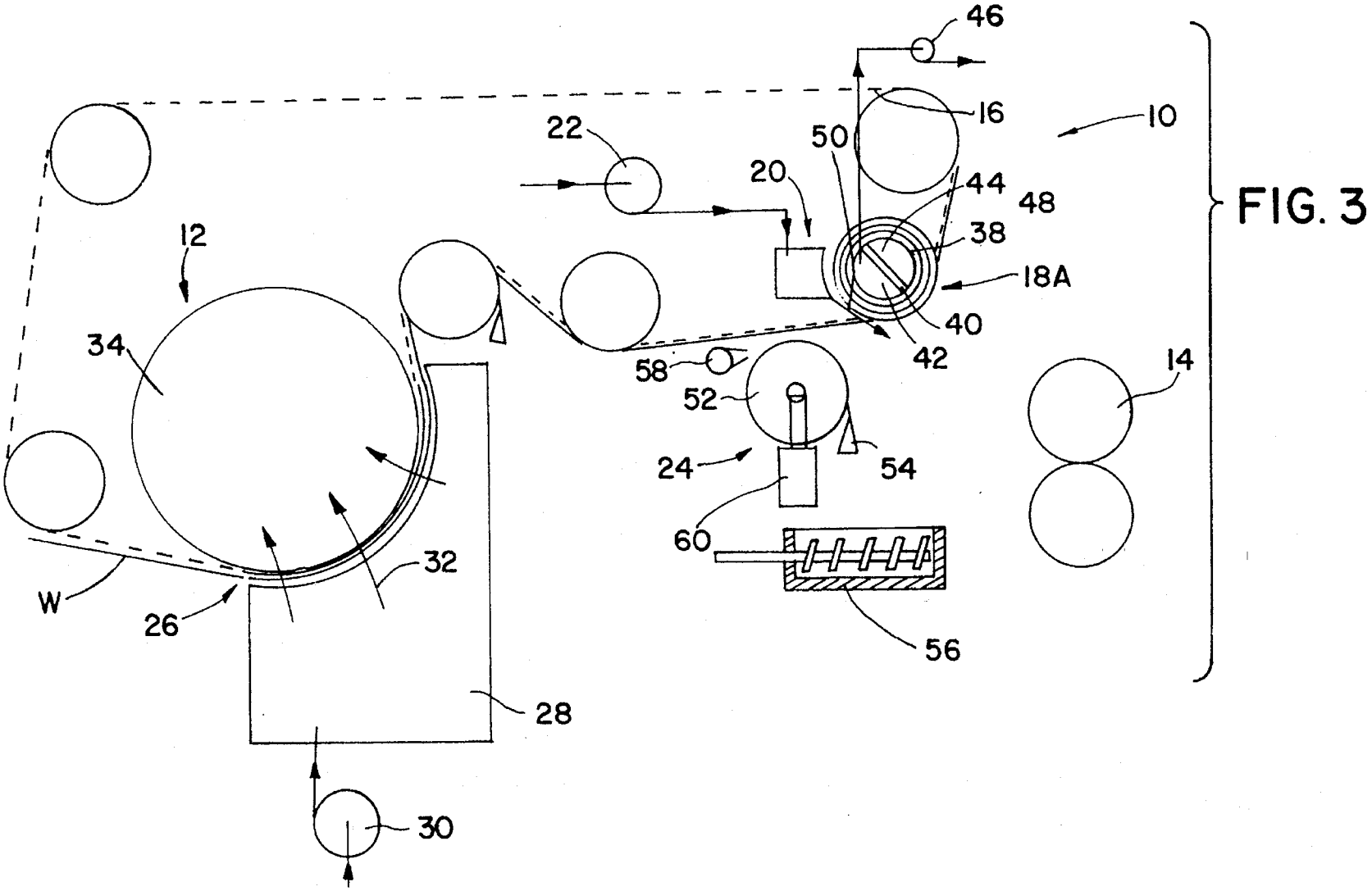
FIG. 3 is a similar view to that shown in FIG. 1, but shows an alternative embodiment of the invention.

In another embodiment of the present invention, as shown in FIG. 3, a lead-out roll 18A includes a stationary housing 38, a longitudinally extending divider wall 40 extending in a cross-machine direction through the housing 38 such that the wall 40 and the housing 38 cooperate together to define a first and a second chamber 42 and 44, respectively. The first chamber 42 is connected to a source of partial vacuum 46.

The lead-out roll 18A also includes a rotatable perforate shell 48 surrounding the housing 38. The arrangement is such that the first chamber 42 is disposed towards the sheet transfer roll means 24.

The blowing means 20 is connected to the source of pressurized air 22 such that when the transfer roll means 24 is in the second position thereof, as shown in FIG. 2, pressurized air, as indicated by the arrow 50, flows from the web blowing means 20 towards the lead-out roll 18 and between the lead-out roll 18 and the felt 16 so that the pressurized air 50 passes through the felt 16 for blowing the web W off of the felt 16 and onto the transfer roll means 24.

The transfer roll means also includes a transfer roll 52 and a sheet shedding doctor 54 cooperating with the transfer roll 52 for doctoring the full width web from the transfer roll 52.

Additionally, the roll means 24 includes a broke pit 56 disposed beneath the transfer roll 52 for receiving the full width web doctored by the doctor 54 from the transfer roll 52.

In a preferred embodiment of the present invention, a water mist shower 58 is disposed adjacent to the transfer roll means 24 for applying water mist to the transfer roll means 24 for assisting a transfer of the web W from the drying section 12 to the calender 14.

The transfer roll means 24 also includes moving means 60 connected to the transfer roll 52 for moving the transfer roll 52 from the first position, as shown in FIG. 1, in which the transfer roll is spaced from the felt 16, to a second position, as shown in FIG. 2, in which the transfer roll 52 presses against the felt 16.

The present invention provides a simple and efficient means for transferring a full width web from a drying section into a calender.

What is claimed is:

1. A sheet transfer apparatus for transferring a web from a drying section to a calender, said apparatus comprising:

a looped felt for supporting the web thereon from the drying section;

a lead-out roll disposed upstream relative to the calender for guiding said felt such that said felt is disposed between said lead-out roll and the web;

full width web blowing means connected to a source of pressurized air and disposed adjacent to said lead-out roll for selectively blowing the web off of said felt; and movable sheet transfer roll means disposed in the vicinity of said lead-out roll, said transfer roll means being movable from a first position to a second position adjacent to said lead-out roll, the arrangement being such that when said transfer roll means is disposed in said second position thereof, said blowing means blows the full width web off of said felt onto said transfer roll means for subsequent guidance thereof to the calender.

2. A sheet transfer apparatus as set forth in claim 1, further including:

a dryer section;

said dryer section including:

a hot air cap connected to a source of pressurized heated air, said air cap directing a flow of heated air against the web and through said felt during mutual movement of said felt and the web past said air cap.

3. A sheet transfer apparatus as set forth in claim 2, wherein said dryer section further includes:

a perforate drying cylinder cooperating with said air cap such that during said mutual movement of said felt and web between said drying cylinder and said air cap, said heated air flows from said air cap through the web and said felt into said perforate drying cylinder.

4. A sheet transfer apparatus as set forth in claim 1, wherein said felt is a web supporting wire.

5. A sheet transfer apparatus as set forth in claim 1, wherein said lead-out roll is a plain roll.

6. A sheet transfer apparatus as set forth in claim 1, wherein said lead-out roll includes:

a stationary housing;

a longitudinally extending divider wall extending in a cross-machine direction through said housing such that said wall and housing cooperate together to define a first and a second chamber, said first chamber being connected to a source of partial vacuum;

a rotatable perforate shell surrounding said housing, the arrangement being such that said first chamber is disposed towards said sheet transfer roll means.

7. A sheet transfer apparatus as set forth in claim 1, wherein said blowing means is connected to said source of pressurized air such that when said transfer roll is in said second position thereof, pressurized air flows from said web blowing means towards said lead-out roll and between said lead-out roll and said felt so that said pressurized air passes through said felt for blowing the web off of said felt and onto said transfer roll means.

8. A sheet transfer apparatus as set forth in claim 1, wherein said transfer roll means further includes:

a transfer roll;

a sheet shedding doctor cooperating with said transfer roll for doctoring the full width web from said transfer roll;

a broke pit disposed beneath said transfer roll for receiving the full width web doctored by said doctor from said transfer roll.

9. A sheet transfer apparatus as set forth in claim 1, further including:

a water mist shower disposed adjacent to said transfer roll means for applying water mist to said transfer roll means for assisting a transfer of the web from the drying section to the calender.

10. A sheet transfer apparatus as set forth in claim 8, wherein said transfer roll means further includes:

moving means connected to said transfer roll for moving said transfer roll from said first position in which said transfer roll is spaced from said felt to said second position in which said transfer roll presses against said felt.

* * * * *